United States Patent [19]

Reinholm et al.

[11] 4,426,887

[45] Jan. 24, 1984

[54] METHOD OF MEASURING PREVIOUSLY APPLIED TORQUE TO A FASTENER

[75] Inventors: James H. Reinholm, Livonia; Eugene J. Marcinkiewicz, Plymouth, both of Mich.

[73] Assignee: GSE, Inc., Farmington Hills, Mich.

[21] Appl. No.: 456,214

[22] Filed: Jan. 7, 1983

Related U.S. Application Data

[63] Continuation-in-part of Ser. No. 372,878, Apr. 29, 1982.

[51] Int. Cl.[3] ..... B25B 23/142; G01L 5/24

[52] U.S. Cl. ..... 73/862.23; 73/761; 364/508

[58] Field of Search ..... 73/761, 847, 862.23, 73/862.24; 364/505, 506, 508

[56] References Cited

U.S. PATENT DOCUMENTS

| | | | |
|---|---|---|---|
| 4,244,213 | 1/1981 | Marcinkiewicz | 73/862.23 |
| 4,259,869 | 4/1981 | Carlin | 73/761 |
| 4,319,494 | 3/1982 | Marcinkiewicz | 73/862.23 |

*Primary Examiner*—Charles A. Ruehl

*Attorney, Agent, or Firm*—Krass, Young & Schivley

[57] ABSTRACT

The amount of previously applied torque to a fastener is measured by analyzing a series of digital torque values generated during a test of the fastener.

6 Claims, 16 Drawing Figures

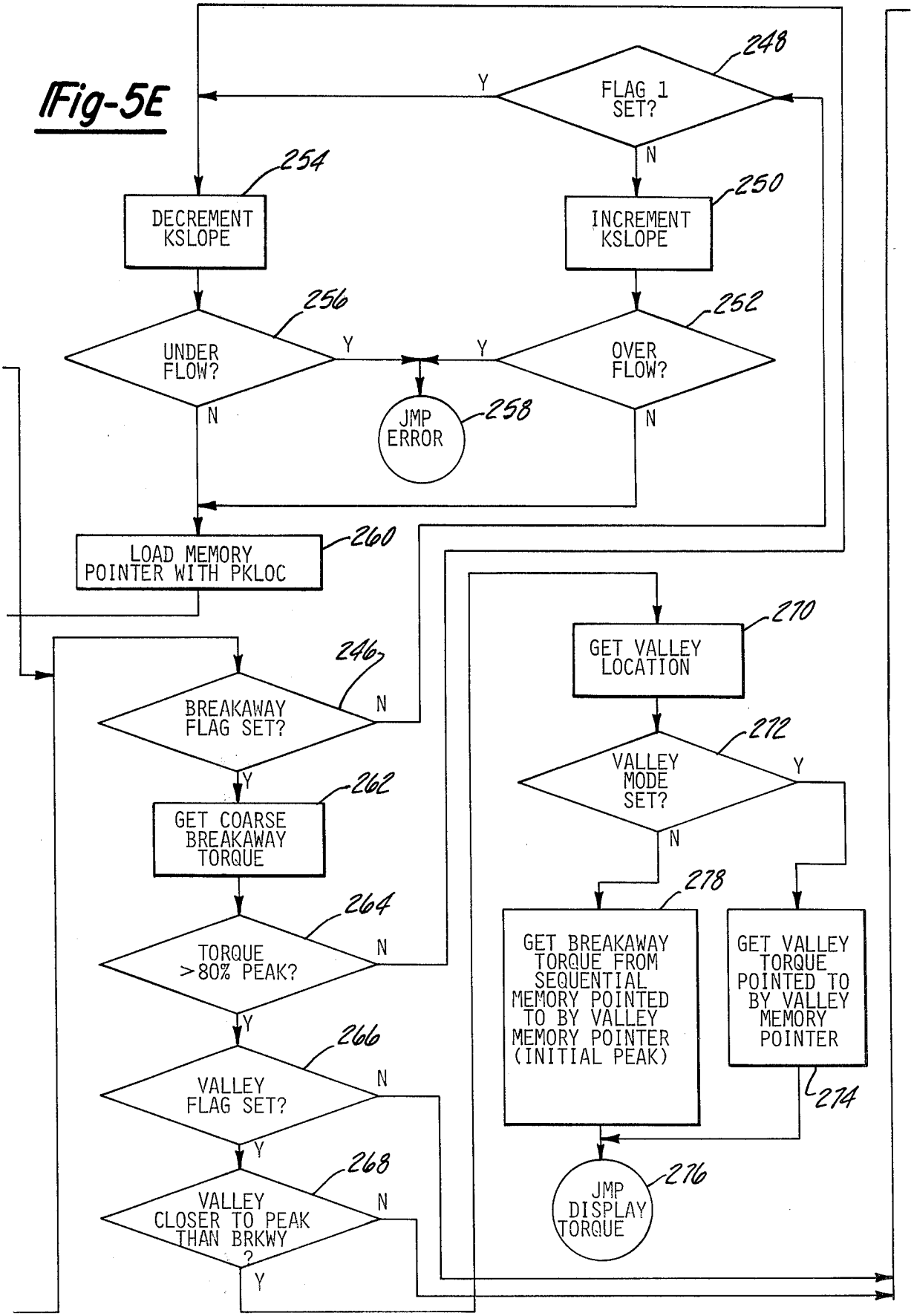
Fig-5E
248
FLAG 1 SET?
Y
N
254
DECREMENT KSLOPE
250
INCREMENT KSLOPE
256
UNDER FLOW?
252
OVER FLOW?
Y
Y
N
N
JMP ERROR
258
LOAD MEMORY POINTER WITH PKLOC
260
246
BREAKAWAY FLAG SET?
N
Y
262
GET COARSE BREAKAWAY TORQUE
264
TORQUE >80% PEAK?
N
Y
266
VALLEY FLAG SET?
N
Y
268
VALLEY CLOSER TO PEAK THAN BRKWY ?
N
Y
270
GET VALLEY LOCATION
272
VALLEY MODE SET?
Y
N
278
GET BREAKAWAY TORQUE FROM SEQUENTIAL MEMORY POINTED TO BY VALLEY MEMORY POINTER (INITIAL PEAK)
GET VALLEY TORQUE POINTED TO BY VALLEY MEMORY POINTER
274
JMP DISPLAY TORQUE
276

METHOD OF MEASURING PREVIOUSLY APPLIED TORQUE TO A FASTENER

DESCRIPTION

CROSS REFERENCE TO RELATED APPLICATIONS

This application is a continuation-in-part of U.S. Ser. No. 372,878, entitled "Digital Retorque Measuring Apparatus", filed Apr. 29, 1982.

TECHNICAL FIELD

This invention relates to torque measuring systems and, more particularly, it involves techniques for sensing the amount of previously applied torque to a fastener.

BACKGROUND ART

In a variety of manufacturing applications it is often imperative that a predetermined amount of torque be applied to a fastener to form a proper joint. For example, in automotive applications, bolts must be tightened within a certain prescribed range of torque to properly join two parts together thereby assuring good reliability of the joint during expected use. A relatively simple test has been used in the past to measure fastener torque levels. An operator uses a hand torque wrench to engage the fastener to be tested. He then uses the wrench to apply more torque to the fastener until it finally begins to rotate in the tightening direction. Early techniques called for the operator to merely view the reading of the wrench torque indicator just prior to the "give" or "breakaway" of the fastener as this torque level was thought to be generally associated with the amount of torque originally applied to the fastener during the normal assembly process. Later improvements of such a test included the use of a wrench which would maintain the position of the indicator at the maximum torque level experienced.

Unfortunately, the prior art methods of sensing the applied torque were not very precise and the results were not capable of being accurately reproduced from operator to operator. The breakaway torque level was hard to accurately measure because it was difficult for the operator to instantaneously stop applying any more torque as soon as he noticed fastener motion. Hence, the torque reading was often too high due to this overshooting problem.

U.S. Pat. No. 4,244,213 and U.S. Pat. No. 4,319,494 to Marcinkiewicz (hereby incorporated by reference) disclose dramatic improvements in retorque measuring techniques. These patents broadly disclose the concept of electronically and automatically detecting the amount of previously applied torque to a fastener. In general, electrical circuitry is used to automatically detect a change in slope of the torque signal. The torque value associated with the occurrence of the slope change is displayed as being representative of the amount of torque previously applied to the fastener. Preferably, the circuitry is adapted to detect the torque signal value associated with a negative valley occurring after the breakaway point. This negative valley torque, when it occurs, provides an even better indication of the amount of torque applied to the fastener during its original tightening process.

While the above commonly assigned patents certainly advanced the state of the art, the particular embodiments disclosed therein for carrying out their broad teachings can be even further improved. Spurious peaks or spikes in the torque signal are often encountered under true operating conditions. These spikes can be generated by things like electrical noise but generally they are due to the operator "jerking" the wrench during the test instead of smoothly applying the torque to the fastener. Unfortunately, the analog circuit approach of the previous patents cannot readily filter out those signals. Since their detection schemes look for changes in relative torque values these spikes could trigger false readings.

The present invention is directed to solving one or more of these problems.

DISCLOSURE OF THE INVENTION

The present invention is broadly directed to a digital torque detection scheme centering around the use of a microprocessor to convert an analog torque signal into discrete digital sample values which are stored and then examined in more detail for given characteristics. During the retorque or retightening process, the microprocessor is devoted almost exclusively to the task of converting the analog input signal into discrete samples. It is not burdened with the chore of making relatively sophisticated calculations during the time that the input data is being received.

In a preferred embodiment, only increasing digital sample values are stored in a sequential memory thereby conserving memory requirements. If valley regions do occur during the retorquing operation, only the negative peak valley occurring therein and a limited amount of associated information is stored. When the operator notices fastener rotation and ceases applying more torque thereto, the digital sample values fall below a given threshold and the microprocessor enters into a search routine.

During the search routine, the microprocessor scans the stored samples beginning with the peak and looking backwards to determine if a valley region has occurred within a predefined window. If so, the negative peak value of the valley occurring within that window is displayed as the indication of the amount of previously applied torque to the fastener. In a second mode of operation where the valley torque is not desired, the value of the digital sample occurring just before the valley region is displayed.

According to a feature of this invention a method is provided to pinpoint the exact value of the breakaway torque in those instances where valleys do not occur or, if they occur, at unreliable points on the torque curve. A digital sample associated with a change in slope of the torque curve occurring before the peak is chosen as an initial coarse breakaway point. After this coarse breakaway point is found, an exact breakaway value is pinpointed by examining the angles of the torque curve associated with samples adjacent to the coarse breakaway point. The sample having the smallest associated angle or arc tangent on the torque curve is chosen as the exact breakaway point and displayed.

The displayed torque readings are expected to be very accurate using the techniques of this invention and minimizes the chances of error which may otherwise result from the operator not smoothly pulling on the torque wrench. This is because the method of this invention utilizes only the portion of the torque curve where the fastener actually begins to move until the time that the operator quits supplying more force. Everything else is effectively ignored and thus, irregular torque readings not containing valid information occurring, for example, during early portions of the test will not adversely effect the accuracy of the measurement.

BRIEF DESCRIPTION OF THE DRAWINGS

Those skilled in the art will come to appreciate the full range of advnatages of various features of this invention by reading the following specification and by reference to the drawings in which.

DESCRIPTION OF THE PREFERRED EMBODIMENTS

Figure 1:
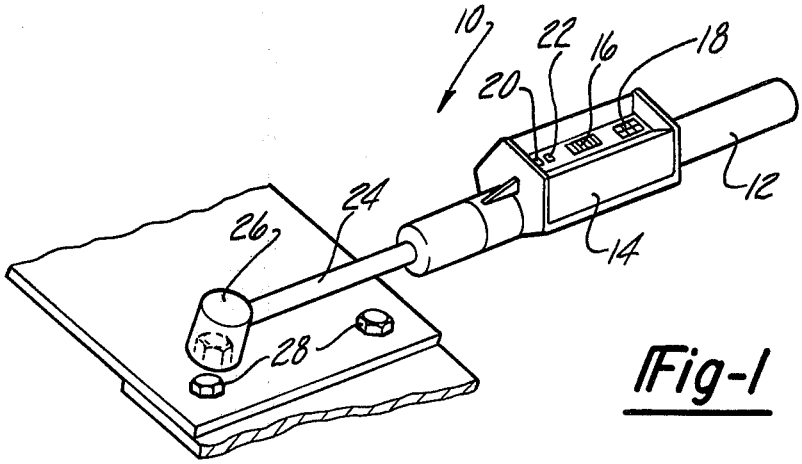
FIG. 1 is a perspective view illustrating a hand torque wrench which may be used to carry out the techniques of the present invention.

FIG. 1 illustrates one example of a torque wrench device suitable for incorporating and using the teachings of the present invention. Torque wrench 10 includes a handle 12 on which housing 14 is mounted on intermediate portions thereof. The interior portion of housing 14 includes the components making up the electronic circuitry which will be described in detail later on in this specification. An LCD display 16, keyboard 18, rotation switch 20 and on/off switch 22 are provided on the top panel of housing 14. A shaft 24 attached to an opposite end of handle 12 includes a cylindrical head 26 at its end. Head 26 includes suitable strain gauges or other transducers therein for sensing the amount of torque applied to a fastener by wrench 10. A more detailed description of torque wrench 10 may be obtained by reference to U.S. Pat. No. 4,124,016 to Lehoczky et al issued Nov. 14, 1978, which is hereby incorporated by reference.

Torque wrench 10 is typically used to test the amount of previously applied torque to a fastener such as bolts 28. Head 26 of torque wrench 10 includes a suitable socket in its lower end for receiving the head of one of the bolts 28. The wrench is then rotated by the operator in the fastening or clamping direction until further rotational movement of bolt 28 is noted. This is commonly referred to in the industry as the "breakaway" of the fastener under test.

Figure 2A:
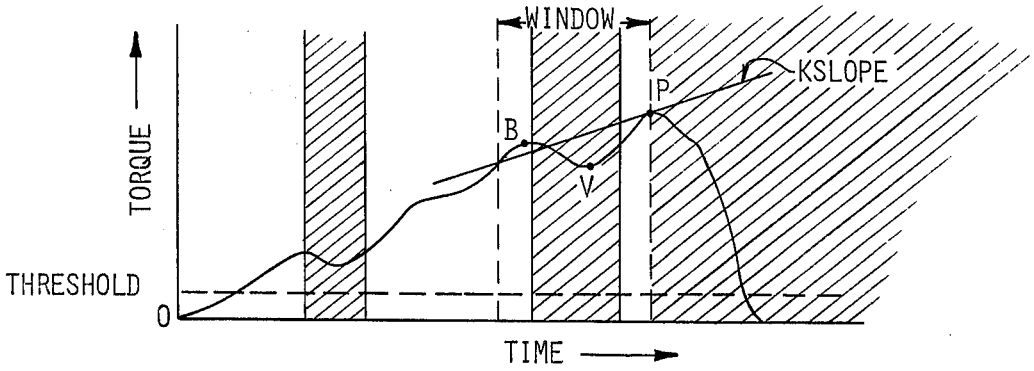
FIGS. 2 (A–C) illustrate torque curves that may be generated during the testing procedure according to the teachings of the present invention.
Figure 2B:
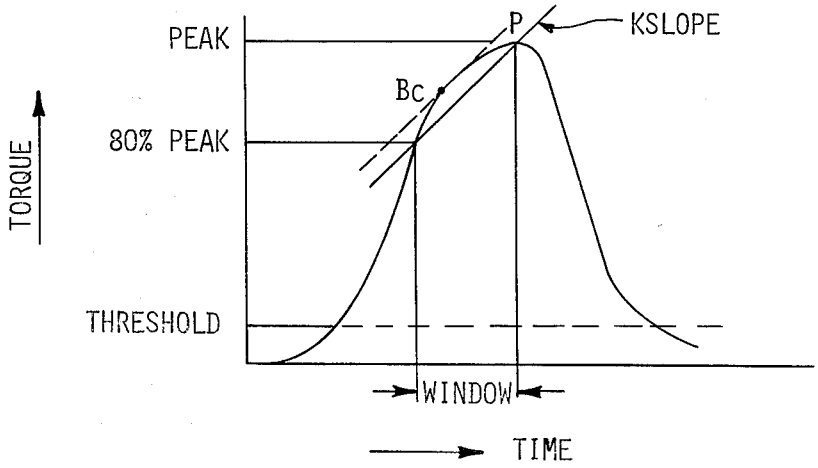

FIG. 2A shows a typical torque level signal curve that may be encountered in this type of retorqueing operation. The torque level generally increases with applied force until such time as the fastener begins further rotational movement. This point shall be referred to as the breakaway torque level and is noted by the reference letter B. In many fasteners the torque level actually decreases for a short period of time even though the operator is still applying force to the fastener. This point is labeled with the reference letter V and shall be referred to as the valley torque. As set forth in the above referenced patents to Marcinkiewicz, valley torque V provides a very close approximation of the amount of torque previously applied to the fastener. In some instances, however, the particular fastener under test does not develop a torque curve with a well defined valley. Instead, the slope of the torque curve merely changes as shown in the curve of FIG. 2B. The torque level will then increase to some peak P until the operator ceases to apply further force to the wrench.

According to the teachings of the present invention, the valley torque value is automatically and precisely identified or, if no valley occurs, the breakaway torque level is identified and displayed. The latter, while not being quite as accurate as the valley torque level, still does provide a close approximation of the amount of torque previously applied to the fastener under test.

Unfortunately, the input torque curve often encounters highly fluctuating torque readings which often occur during the early phases of the retorqueing process as shown in FIG. 2A. As noted above, these fluctuations can be caused by electrical noise or by operator error in not smoothly applying force to the fastener under test. As will appear later herein the present invention provides the capability of precisely detecting the valley or breakaway torque levels in spite of these occurrences.

Figure 3:
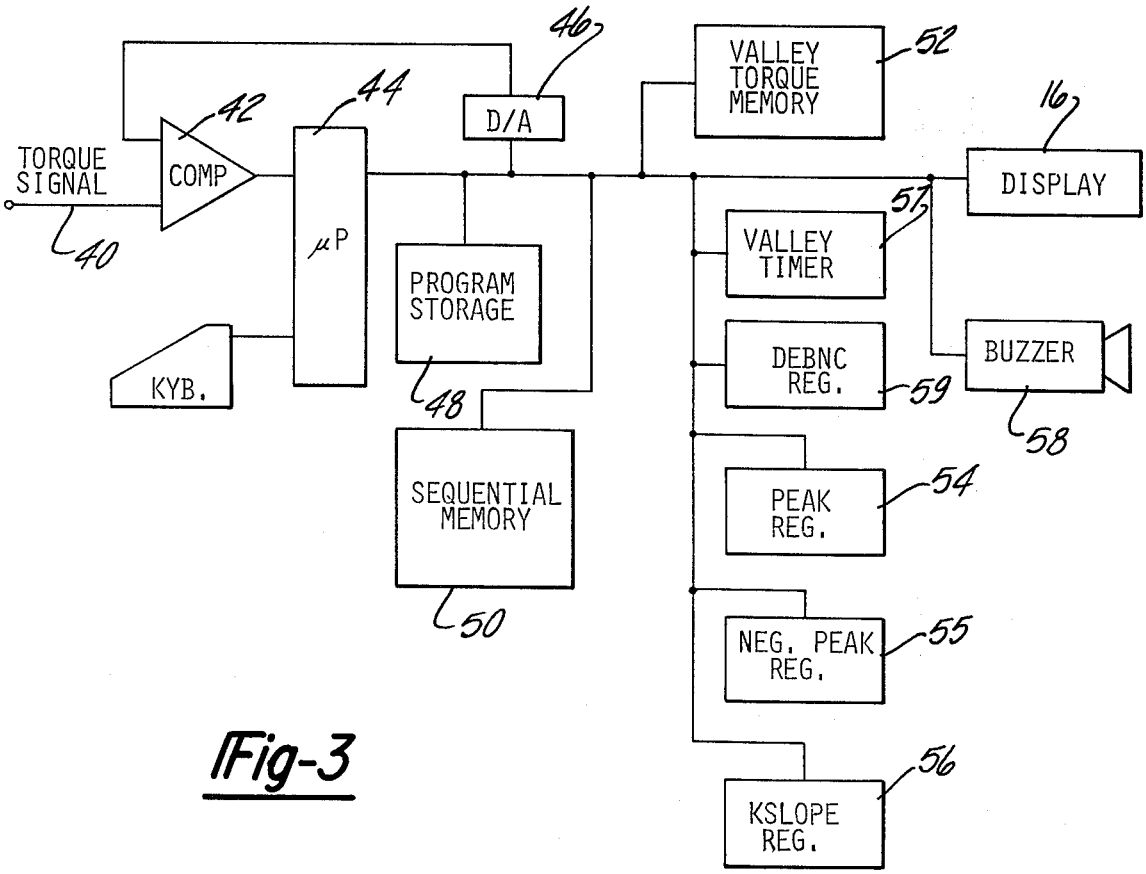
FIG. 3 is a block diagram of the electrical circuitry of the preferred embodiment.

Turning then to FIG. 3 there is disclosed a block diagram of the major functional components of the hardware for carrying out the method of the present invention. The analog input torque signal is supplied over line 40 to one input of a comparator network 42. The analog torque signal is representative of the amount of torque applied to the fastener. Typically, strain gauges in torque wrench head 26 are configured in a Wheatstone Bridge circuit whose output forms the analog torque signal.

The system employs a microprocessor 44 which forms the heart of a microcomputer system. Microprocessor 44 has an output which is connected to a digital to analog converter 46 whose output is coupled back to another input of comparator 42. Under the control of a program within program storage memory 48 the microprocessor 44 uses a reiterative process to generate discrete digital samples from the analog input signal. The microprocessor 44 converts the output signal from comparator 42 into a binary number which is, in turn, converted back to an analog signal by way of D/A converter 46. The analog output of converter 46 is compared to the torque signal and fed back to the input of microprocessor 44. This interactive process is repeated until a binary number is found which is equivalent to the analog torque signal.

As each new digital sample value is generated it is compared with the previously generated digital sample. If it is greater than the earlier sample it is stored in a sequential memory 50 on a first in/first out (FIFO) basis. Accordingly, only progressively increasing digital sample values will be stored in memory 50. If a valley is detected, a flag is placed in the next memory 50 location. All of the digital sample values associated with the valleys or after the peak is reached are not stored in memory 50 as illustrated by the shaded portions in FIG. 2A. Instead, just pertinent information such as the negative peak torque sample value for each valley is stored. This valley information is stored in valley torque memory 52.

This sample and storing process continues throughout the test until the operator stops pulling on the wrench 10 and the sample values become less than a given threshold level. During the retorquing operation the largest digital sample value is stored in a peak register 54. When the retorquing operation is completed, the contents of the peak register 54 has a value associated with the point "P" on the torque curves of FIGS. 2 (A–C). There are several advantages to this sample and storing process. First, is that a substantial savings in memory space is obtained. Secondly, and perhaps more importantly, fluctuations of the torque curve due to mishandling of the wrench by the operator will not significantly effect the accuracy of the system's ability to accurately determine the breakaway or valley torque level.

The next broad step is for the microprocessor 44 to examine or search the data sample values stored within sequential memory 50. A subset or window of data samples within the sequential memory is defined. This window is chosen to be wide enough to encompass the expected breakaway and valley torque values but should not be any larger than necessary. In the preferred embodiment, this window is chosen to include those digital samples having values less than 99% and greater than 80% of the peak value.

The microprocessor 44 then scans the samples in sequential memory 50 beginning with the peak value and progressing to decreasing values, i.e. looking backward, to determine if a valley region has occurred within the window. If so, the negative peak value stored in valley torque memory 52 is generally displayed on display 16 as the indication of the amount of previously applied torque to the fastener. Alternatively, or in addition to display 16, there may be provided a printer for generating a hard copy of the test results. The system utilizes buzzer 58 to alert the operator to various conditions.

If a recognizable valley has occurred within the window but the wrench 10 has been placed in a breakaway only mode (as will be explained) then microprocessor 44 will choose the digital data sample occurring just before the valley to be displayed on display 16. In FIG. 2A this point is labeled "B". A more difficult task is the determination of the breakaway point where no discernible valley has occurred as shown in FIG. 2B. The detection of the breakaway point under these circumstances will be described in detail later herein. The K slope register 56 will be used in performing this calculation.

Figure 4A:
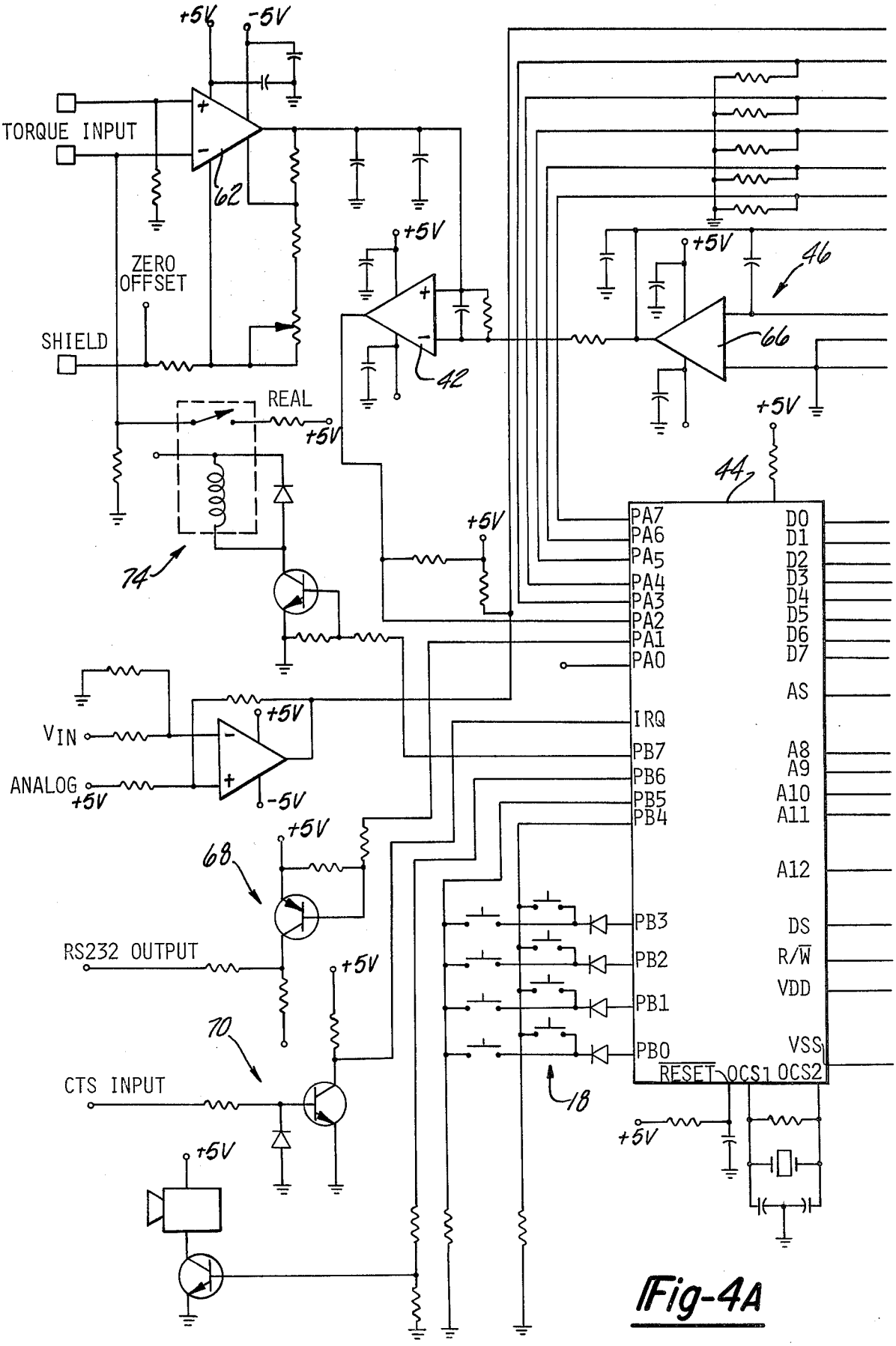
FIGS. 4 (A–B) are a schematic diagram showing the details of the electrical circuitry of the preferred embodiment.
Figure 4B:
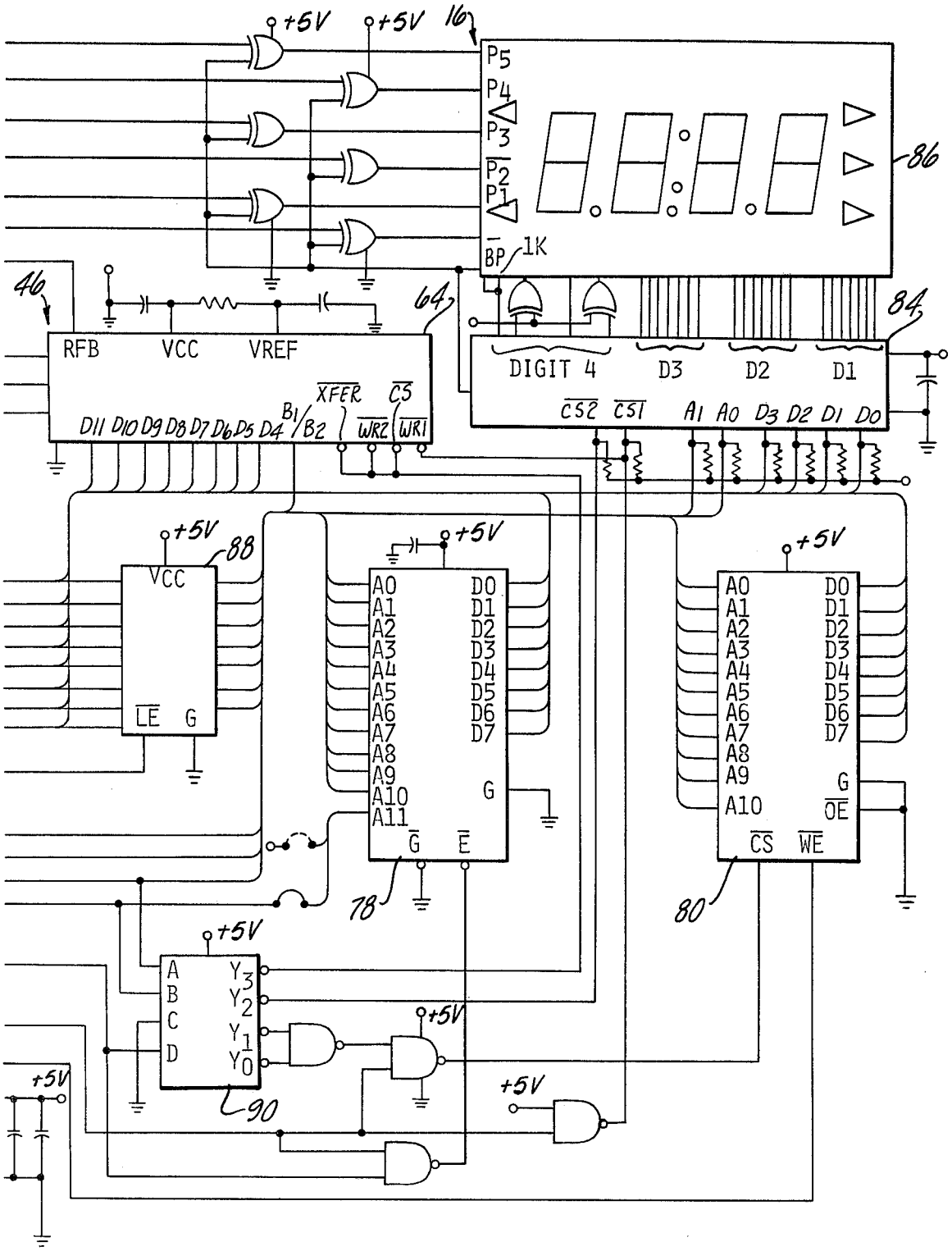

FIGS. 4(A–B) are electrical schematic of the components making up the system of the preferred embodiment. Microprocessor 44 is an eight bit microprocessor such as the Motorola MC146805. As known in the art, microprocessor 44 includes various input/output ports for receiving and sending information. Among the inputs to microprocessor 44 are the switches associated with keyboard 18. Keyboard 18 allows the user to select various modes of operation and to enter control data values. For example, one mode that can be selected will cause the system to detect the absolute peak torque (peak mode) that is applied to the fastener under test. Another modes of operation adapt the system to track or display the instantaneous torque value. Of particular concern to the present invention is the retorque mode to detect breakaway torque only or in a second retorque mode where the valley torque is displayed if one occurred during the test and, if not, then to display the breakaway valve.

The operator can program in a threshold torque value and a KSLOPE value that are selected for the particular fastener characteristics under test. As will become apparent later herein, the threshold torque value is the value above which the microprocessor will generate digital samples from the analog torque signal. Normally, the threshold is set at a sufficiently high level that extraneous input signals generated during set up are effectively ignored. The KSLOPE value is an optional parameter which may be used to modify the reference slopes used to identify the general or coarse breakaway point. Normally, it is set to one. The importance of this KSLOPE value will become apparent later herein. Suffice it to say that the user has a considerable degree of flexibility in defining the particular parameters of the test to be performed. This flexibility is especially advantageous due to the fact that the same torque wrench and detection system may be used for a wide variety of different fasteners, each having their own particular tightening characteristics.

The output from the strain gauge bridge or analog input signal is sensed by a differential amplifier 62 whose inputs are coupled to the two outputs of the bridge. The output of differential amplifier 62 thus is a voltage whose absolute magnitude is proportional to the amount of torque applied to the fastener. The output of differential amplifier 62 is connected to the noninverting input of comparator 42. The inverting input of comparator 42 is coupled to the output of digital to analog converter 46. The output of comparator 42 will either be a logical one or zero depending upon the relationship between the voltage values at its inputs. As long as the analog torque signal on the noninverting input is greater than that supplied by D/A converter 46 to the inverting input, microprocessor 44 will see a logical 1 at its input. As will be described in connection with the conversion routine, the microprocessor generates a binary number and sends this number to the input of D/A converter 46. D/A converter 46 is a CMOS binary multiplying digital to analog converter using conventional ladder switching techniques to effect the conversion process. In this particular embodiment D/A converter 46 utilizes a DAC1232 component 64 made by National Semiconductor. The output of component 64 is coupled to an op amp 66 in the manner suggested by the component manufacturer. Op amp 66 serves as an inverting amplifier whose output has an absolute magnitude proportional to the digital value at the input to D/A converter 46.

Other inputs to microprocessor 44 may include circuitry generally designated by the numerals 68 and 70 for communicating with an optional printer. The circuitry 68 provides outputs to the printer whereas circuitry 70 accepts acknowledgement signals from the printer.

Circuitry 74 operates as a calibration circuit. When the system enters the calibration mode the relay in the circuit activates the switch which, in turn, couples the precision calibration resistor to amplifier 62 so that its output is equivalent to a full scale reading. Suitable calibration techniques may be then used to calibrate the system. The oscillator circuitry 76 generates the master clock signal for driving microprocessor 44 in the manner known in the art. Suitable circuitry for driving buzzer 60 is also connected to microprocessor 44.

The output of microprocessor 44 is connected to external memory devices and display 16 as well as to the D/A converter 46. The memory devices include a programmable read only memory 78 which contains the operating program for the microprocessor 44 and a random access memory (RAM) 80. Display 16 includes a display driver component 84 for controlling the operation of a multidigit liquid crystal display (LCD) 86. The transfer of data within the system including the reading and writing of the memories are carried out in a manner known in the art and may include such devices as address buffer 88 and a binary to BCD decoder 90 serving as a chip selector.

Selected sections of RAM memory 80 are used as the sequential memory 50, valley torque memory 52, and the various registers 54–59. Those skilled in the art will appreciate that the purpose of registers 54–59 is to temporarily store data and thus, the registers may be made up of individual storage devices or, as in the preferred embodiment, dedicated locations within a larger RAM memory. In fact, the internal memory (not shown) in microprocessor 44 may be used in some instances.

With additional reference to the flow chart of FIGS. 5 (A–J), the operation of the system of this invention will be described. When the user chooses either of the retorque modes of operation the microprocessor is instructed by the program shown in FIGS. 5 (A–J). Initially, all of the counters, registers and flags pertinent to this routine are cleared as illustrated in steps 102–104 (FIG. 5(A)). As the operator uses wrench 10 to apply torque to the fastener under test the analog torque signal is converted into digital values by way of the conversion routine shown in FIGS. 5G–J.

The A/D conversion routine is entered by way of a software interrupt (SWI) 120 which occurs about once every two milliseconds to generate a digital sample with a value corresponding to the analog torque signal value occurring at the time the sample is taken. The microprocessor is designed to convert the analog signal into a precision twelve bit data value, even though the microcomputer system employs conventional eight bit processing techniques. FIGS. 5H shows the steps used to generate the first eight bits of the digital sample value. Briefly, the most significant eight bits of the previous value which was stored in memory is fetched and fed to the input of D/A converter 46. After waiting about 2 μsec for the output of the D/A to be generated, the microprocessor determines whether that signal is greater or less than the analog torque signal. Depending on the outcome of those tests the microprocessor increases or decreases the value of the most significant eight bits of the sample value until approximate matching occurs. Then in FIG. 5J the microprocessor uses a successive approximation technqiue to set the lower four bits to the precise value. The upper eight bits are saved for the next conversion routine.

Returning to FIG. 5A, each new torque reading is tested in step 152 to determine whether it is greater than the user programmed threshold value. Until that time, the system will continue in loop 1 merely displaying the generated torque value. Once the value is greater than the threshold, a flag is set (step 154) and the system begins saving selected sample values.

Figure 5A:
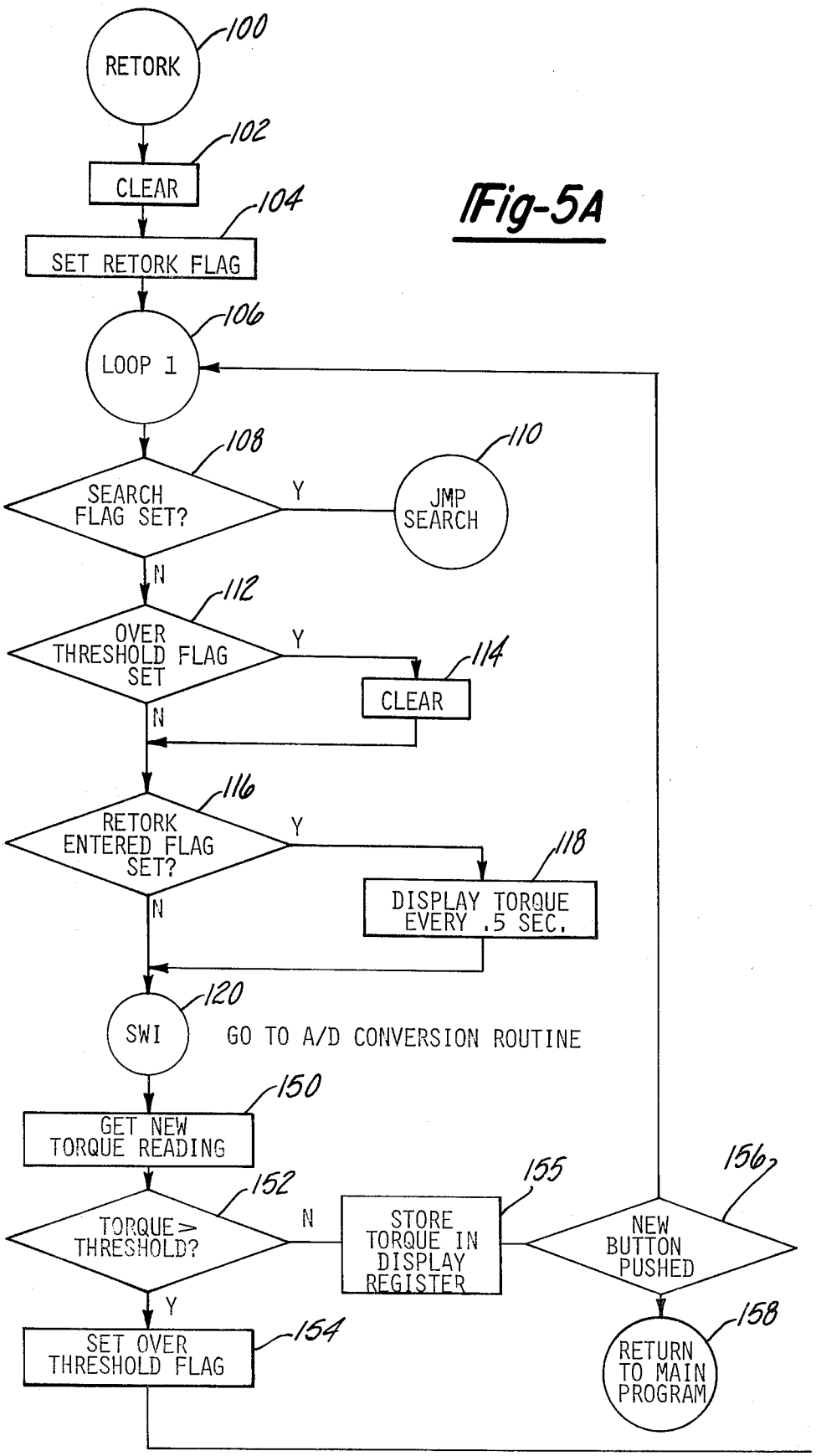
FIGS. 5 (A–J) are a flow chart illustrating sequential steps to be performed in carrying out various aspects of the preferred embodiment of the present invention.
Figure 5B:
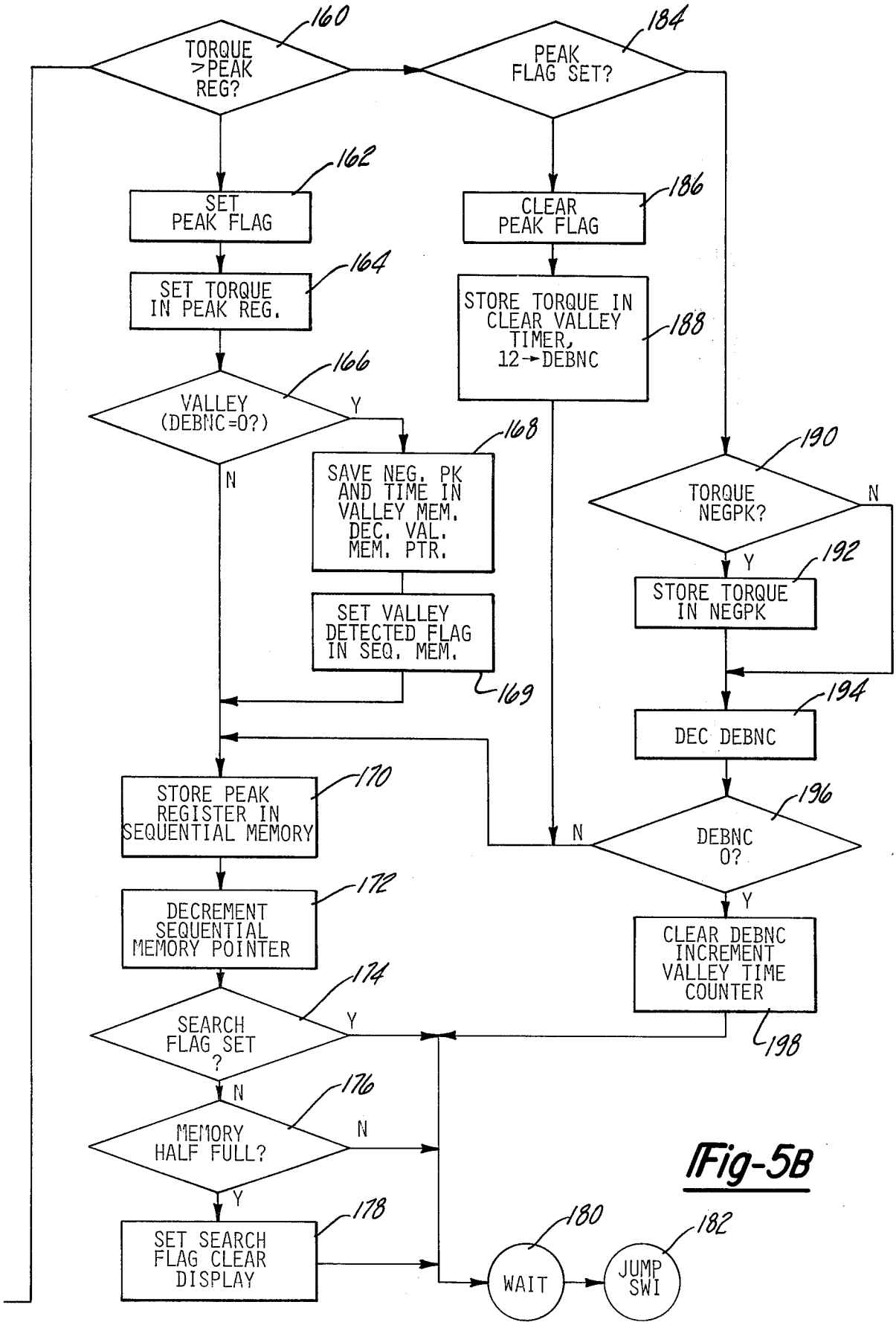

Turning then to FIG. 5B, the microprocessor 44 will sample the analog input signal at about a two millisecond rate and will store the digital samples in sequential memory 50 with the new torque sample values replacing the older values. Peak register 54 is used to store the highest digital sample value generated during the test. As represented by step 160, each successively generated digital sample is compared with the contents of the peak register 54. If the new digital sample value is greater than the contents of the peak register 54 a peak flag is set and the new torque value is stored in register 54 along with its location in PKLOC. (steps 162–164). Assuming that the samples not associated with a valley (steps 166–169) the contents of the peak register 54 is also stored in sequential memory 50 and the memory pointer, i.e. address register, is decremented ready to receive the new sample value (steps 170–172). The program now jumps (step 182) back to the A to D conversion routine via the software interrupt 120 of FIG. 5A to thereby generate the next sample.

If the next sample is less than the peak register 54 and the peak flag is set (step 184, FIG. 5B) this is considered as the start of a valley region. At this point, the peak flag is cleared (step 186). The next step 188 is to store the smaller sample value in negative peak register 55. A valley counter or timer 57 associated with memory 52 is cleared and a debounce register 59 is set or loaded with the value of 12. The debounce register effectively acts as a filter allowing subsequent digital sample values below the peak to continue to be stored into sequential memory 50 until 12 consecutive torque values are found that are less than the peak. Electrical noise or other factors may create a small number of decreasing sample values and, thus, the debounce operation and valley timer are used to disregard such occurrences as true valleys.

In step 190 a test is made to determine whether the next torque value (less than the peak) is less than the previous negative peak stored in negative peak register 55. If so, that torque replaces the previous contents of negative peak register 55. In either event, the debounce register is decremented in step 194 and a test is made in step 196 to determine whether the contents of the debounce register is less than zero. If the debounce register has not been fully decremented the torque values are also stored in sequential memory 50 (step 170). However, once the debounce register has been decremented to zero then the digital samples less than the peak will not be stored in sequential memory 50. Valley timer 57 is incremented and the debounce register is cleared (step 198). The purpose of the valley time counter is to determine the length of time that the torque curve is in a valley region; i.e. samples having values less than the previously generated peak value.

Once a true valley region has been detected no further samples are stored in sequential memory 50 until the value of a subsequent sample exceeds the value stored in peak register 54. Only the least positive digital sample occurring during a valley is stored in the negative peak register 55. The valley timer 57 is also incremented during this time.

Once a digital sample has a value greater than the stored value in peak register 54, the end of the valley has been reached and the test 160 will become true again. The program progresses to step 166 which determines whether a valley has previously occurred by checking the contents of the debounce register 59. If it is zero then the valley parameters are stored in valley torque memory 52 as represented by step 168. The valley parameters are the length of time in the valley provided by the contents of timer 57, and the negative peak associated with that valley provided by negative peak register 55. A valley memory pointer is decremented ready to save new valley parameters if they occur during the test. In step 169 a valley detected flag is stored in sequential memory 50 to indicate that a valley occurred before the next larger sample is stored therein (step 170).

It will be appreciated that this method of storing torque values generally allows only increasing values to be stored in sequential memory while only a limited amount of compact data is stored for each of the valley regions. This technique operates to conserve memory space and thus decrease costs.

In this embodiment, memory 50 has a capability of storing 256 different torque values. When the memory becomes half full (step 176) it is assumed that the operator is really performing a retorquing operation on the fastener and that sufficient data has been obtained to determine breakaway or valley torque values. Accordingly, a search flag is set in step 178 signifying that the system is ready to perform the breakaway or valley search routine once the retorquing operation is finished. Returning to FIG. 5A, test 152 will become false once the operator stops applying any more force to the wrench 10 and the torque values fall below the threshold level. The routine then branches up through loop 106 and if the search flag has been set (step 108) then the program jumps to the search routine shown in FIGS. 5(C–F).

Before describing the search routine it may be advisable to summarize the contents of the various memories and registers. Sequential memory 50 will contain progressively increasing digital sample values that were generated during the retorquing operation. Valley torque memory 52 will contain the smallest or negative peak sample value occurring for each valley as well as the length of time that the valley region occurred. Peak register 54 will contain the largest digital sample value that was generated during the operation.

Figure 5C:
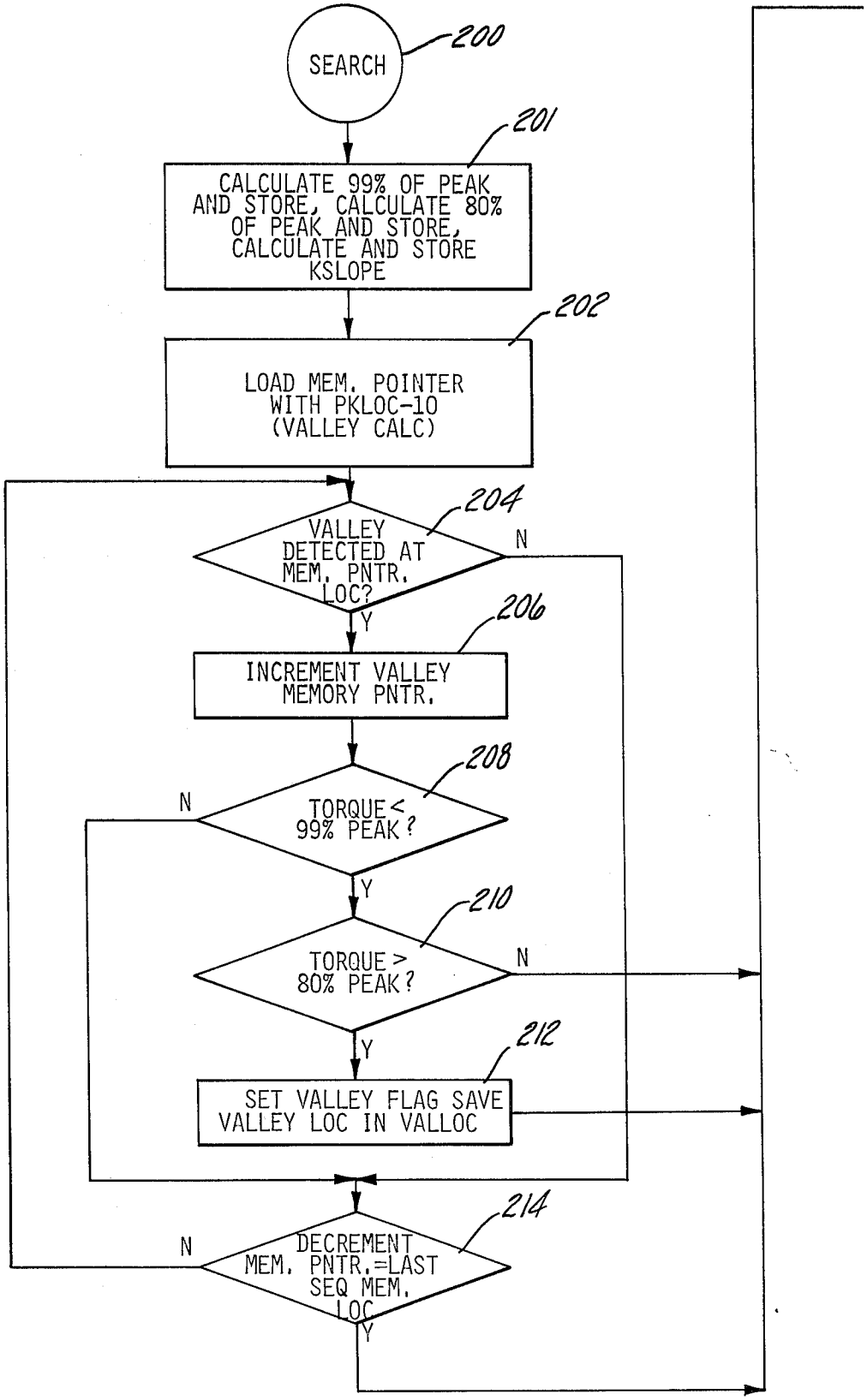

Turning then to FIG. 5C, the search routine will initialize itself (step 202) by calculating 99% of the peak value and 80% of the peak value, with the program storing these parameters in suitable working registers. A slope is then calculated by taking the slope of a line containing the peak and 80% of the peak value on the torque curve. This slope is shown in FIG. 2A as KSLOPE and is stored in the Kslope register 56 (FIG. 3). This slope may be multiplied by an optional fraction parameter which may be entered by the user via keyboard 18 although it is normally set to 1.

The next step is to begin to look for a valley region if a recognizable valley has occurred during the retorquing operation. In step 202 pertinent flags are cleared and a sequential pointer is loaded with an address associated with a digital sample occurring just prior to the peak. In this example, the address is associated with the digital sample in sequential memory 50 occurring ten samples before the peak. Now the entire sequential memory 50 is scanned backwards starting from this location until a valid valley region is found which is less than 99% of the peak and greater than 80% of the peak, these two values defining a window where accurate values of the breakaway or valley torque level will normally be found.

In step 204 the contents of the sequential memory location addressed by the pointer will be read. It will be remembered that step 169 in the sample generation and storage routine (FIGS. 5A and B) will have placed a flag in memory 50 at the location where a valley has occurred. If this flag is detected the microprocessor 44 increments a pointer for the valley memory 52 and reads the parameters stored at that address locations. In particular, steps 208 and 210 determine whether the negative valley peak value is within the 99–80% window. If so, a valley flag is set and the parameters are transferred to a working register referred to as VALLOC in step 212. Test 214 causes this process to loop back and search for all of the valleys that may have occurred. However, only those valleys having negative peak values within the window will be considered as valid and, more particularly, the first valley occurring prior to the peak will be selected as the most accurate even if two or more negative peak values satisfy the above criteria.

In summary, the routine just described is used to determine the first valley, if any, that has occurred just prior to the peak of the torque curve.

Figure 5D:
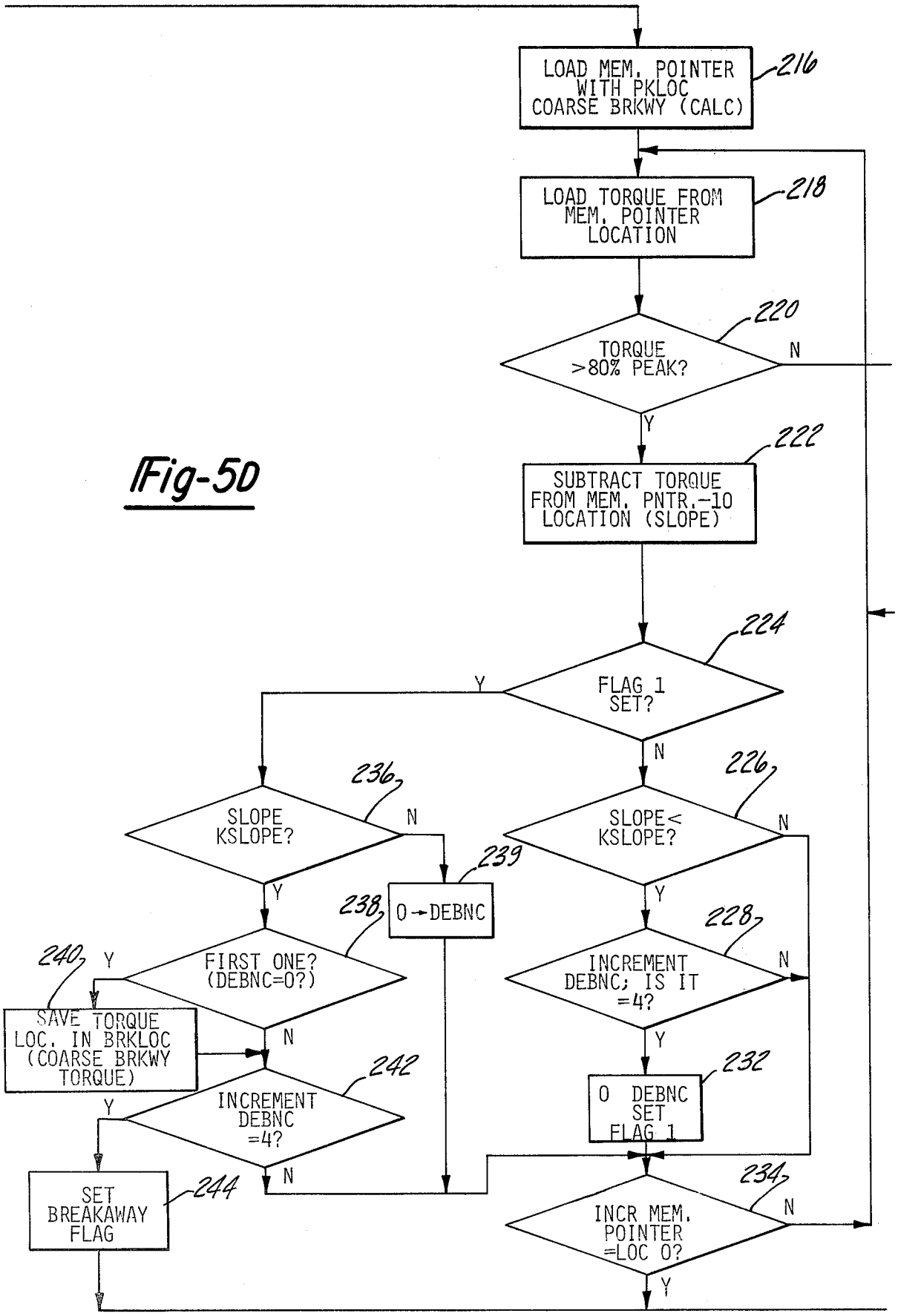

After this valley detection subroutine is completed, microprocessor 44 then will search for and calculate a breakaway torque. Turning then to FIG. 5D, the sequential memory 50 pointer is loaded again with the address location (PKLOC) of the peak sample value. (step 216) The addressed torque value is read and compared with the 80% peak criteria (steps 218 and 220). If the latter test is true, a slope is calculated by taking the difference of two torque values ten samples apart. This is performed in step 222 where the torque of the present sample is subtracted from the torque associated with a sample located at a tenth earlier address in sequential address memory 50. This slope is then compared with the previously calculated KSLOPE in step 226. When four slopes are found that are less than KSLOPE a flag 1 is set (steps 228–232). After flag 1 is set, microprocessor 44 continues to scan sequential memory 50 until four consecutive segments are found with slopes greater than KSLOPE. Briefly, this is accomplished by step 236 which compares each segment with K slope. The largest torque value associated with the first segment having a slope greater than KSLOPE is defined as the coarse breakaway torque value $B_c$ and its location is stored in a register referred to as BRKLOC. (steps 238–230) Step 242 increments the debounce register 59 and determines whether it has reached the number four. Once four consecutive segments have slopes less than KSLOPE test 242 becomes true and a breakaway flag is set (step 244).

The purpose of the coarse breakaway routine described in connection with FIG. 5D is to select from sequential memory 50 an approximate value of the torque associated with breakaway. The routine operates to identify that point on the torque curve generally associated with a knee where the curve begins to undergo a change in slope. A generalized approximation of this point is provided by the routine described above by first checking for a consecutive number of slopes less than the predefined KSLOPE and then selecting the torque value associated with a slope segment transitioning to slopes greater than KSLOPE. Remember, that in this embodiment the memory is scanned backwards. Under some instances the 99–80% KSLOPE criteria will not result in detection of the course breakaway point having a value greater than 80% of the peak as required by test 220. In such instances, the program branches to step 246 of FIG. 5E. If the memory pointer has read a torque value below 80% of the peak before the breakaway flag is set, the KSLOPE value is either incremented or decremented, depending upon the status of the flag 1 (steps 248–256). The coarse breakaway routine of FIG. 5D is then repeated via step 260 until the KSLOPE value has been incremented or decremented beyond acceptable limits as determined by steps 252 and 256, respectively. In such case an error signal is provided as represented by step 258 and the retorque program is reinitialized from the beginning. This may happen when there is no clear breakaway on the torque curve or if the torque increases linearly from threshold to peak. The error signal thus indicates to the operator that he should run another test on the fastener.

Under normal conditions the breakaway flag will be set because the microprocessor is capable of detecting a change in slope of the torque curve. As noted in the background portion of this invention, the torque curves for some fasteners will exhibit recognizable valleys as shown in FIG. 2A whereas others will generate a torque curve similar to that shown in FIG. 2B with no discernible valley. In those instances where a valley does occur, the most accurate breakaway point occurs just before the valley. Sometimes, however, the generated torque curve will have a valley which occurs before the detected course breakaway point. Such instances will result in an erroneous measurement and may be due to such things as the operator jerking the torque wrench, electrical noise, or various anomalies in the particular fastener being tested. Thus, the selection of the actual torque value to be displayed as an indication of the previously applied torque to the fastener must be carefully determined.

In this embodiment, the coarse breakaway torque is checked to determine whether it is greater than 80% of the peak torque value. (step 264) If so, and if the valley flag is set indicating that a recognizable valley has been generated, then the microprocessor determines whether the valley is closer to the peak than the coarse breakaway point as represented by the test of step 268. This may be accomplished by comparing the relative address locations of the valley detected flag and the coarse breakaway sample in memory 50. If the valley is closer to the peak than the coarse breakaway point, as it should be, then the valley location (VALLOC) is obtained and a check is made to determine what retorque mode has been programmed by the operator (steps 270–272) If the valley mode has been set, then the negative peak valley torque is displayed as the indication of previously applied torque to the fastener (steps 274, 276). This value would correspond to the point labeled V in FIG. 2A. If the valley mode is not set then the point labeled B in FIG. 2A is displayed. This point corresponds with the torque value in sequential memory 50 which is located just before the flag which identified the valley. Conveniently, this may be accomplished by utilizing VALLOC to address the location in sequential memory 50 containing the torque value occurring must before the valley.

Figure 5F:
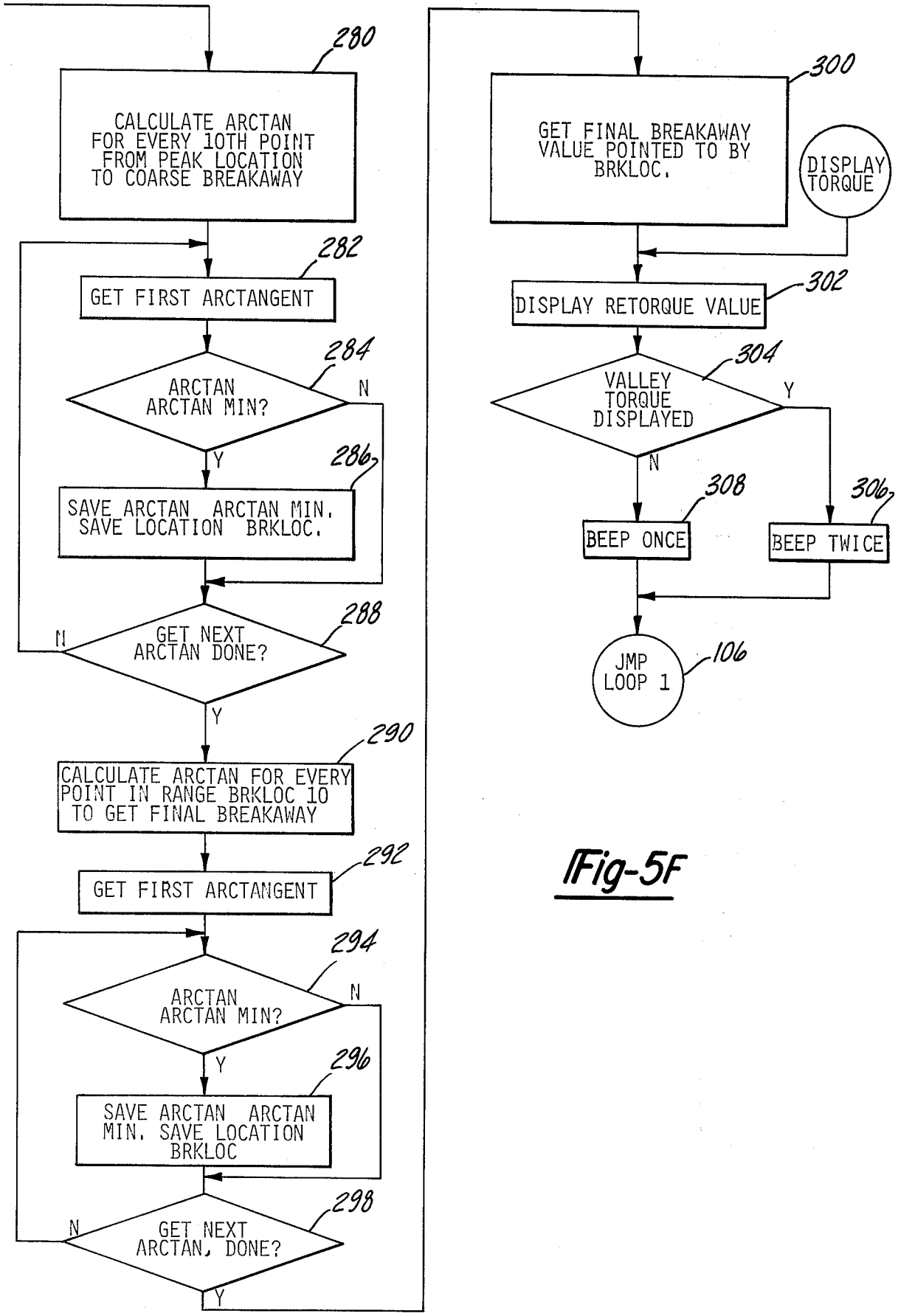
Figure 5G:
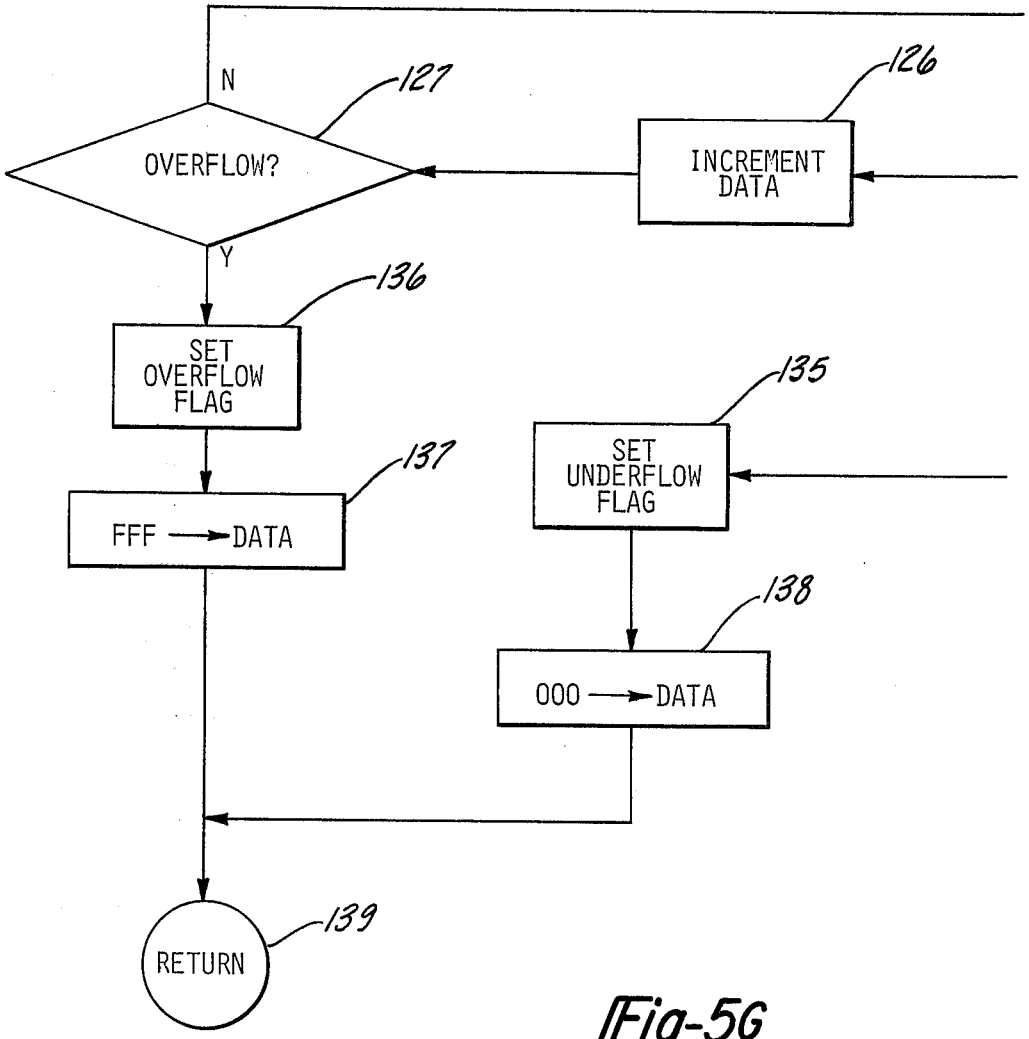
Figure 5H:
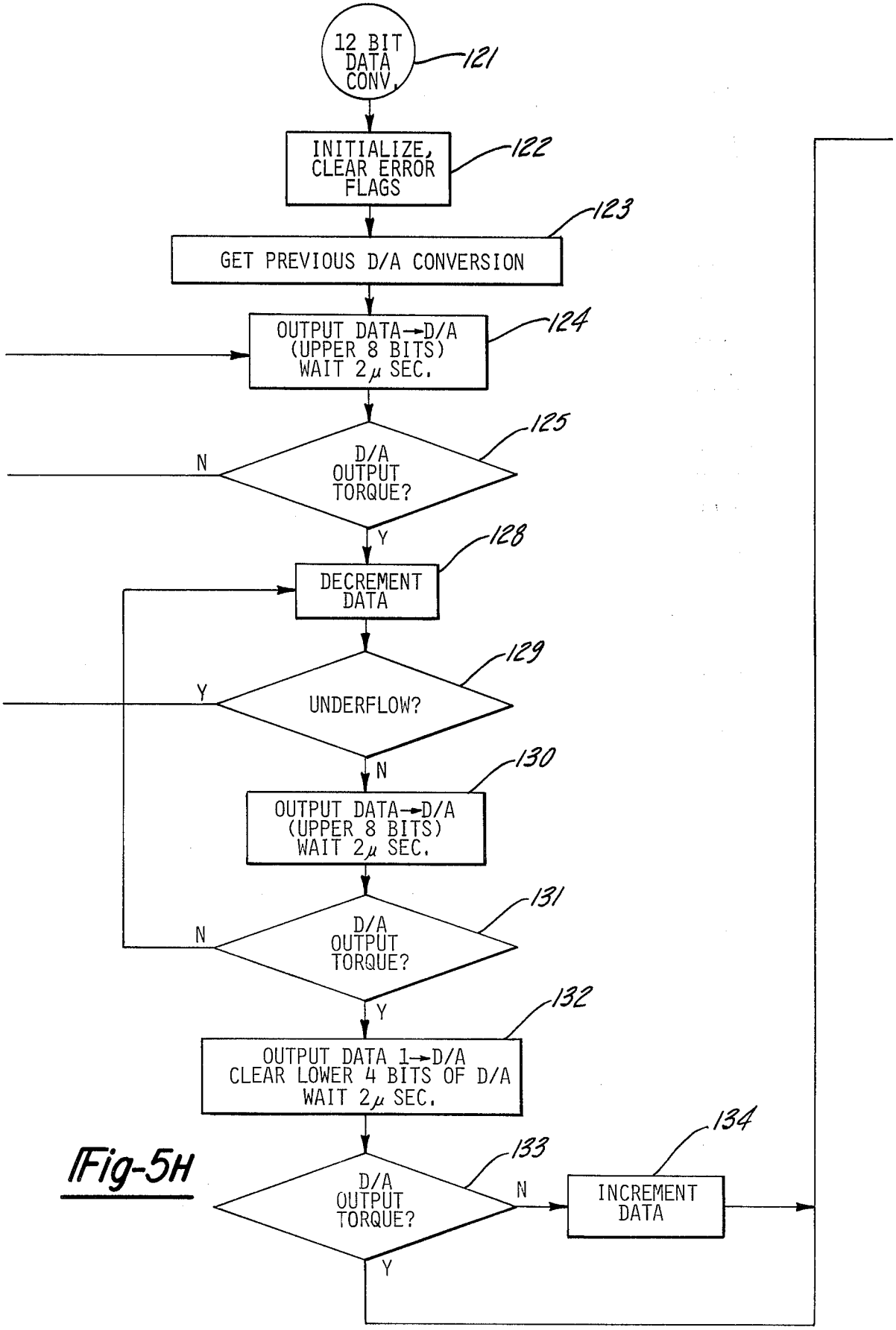
Figure 5J:
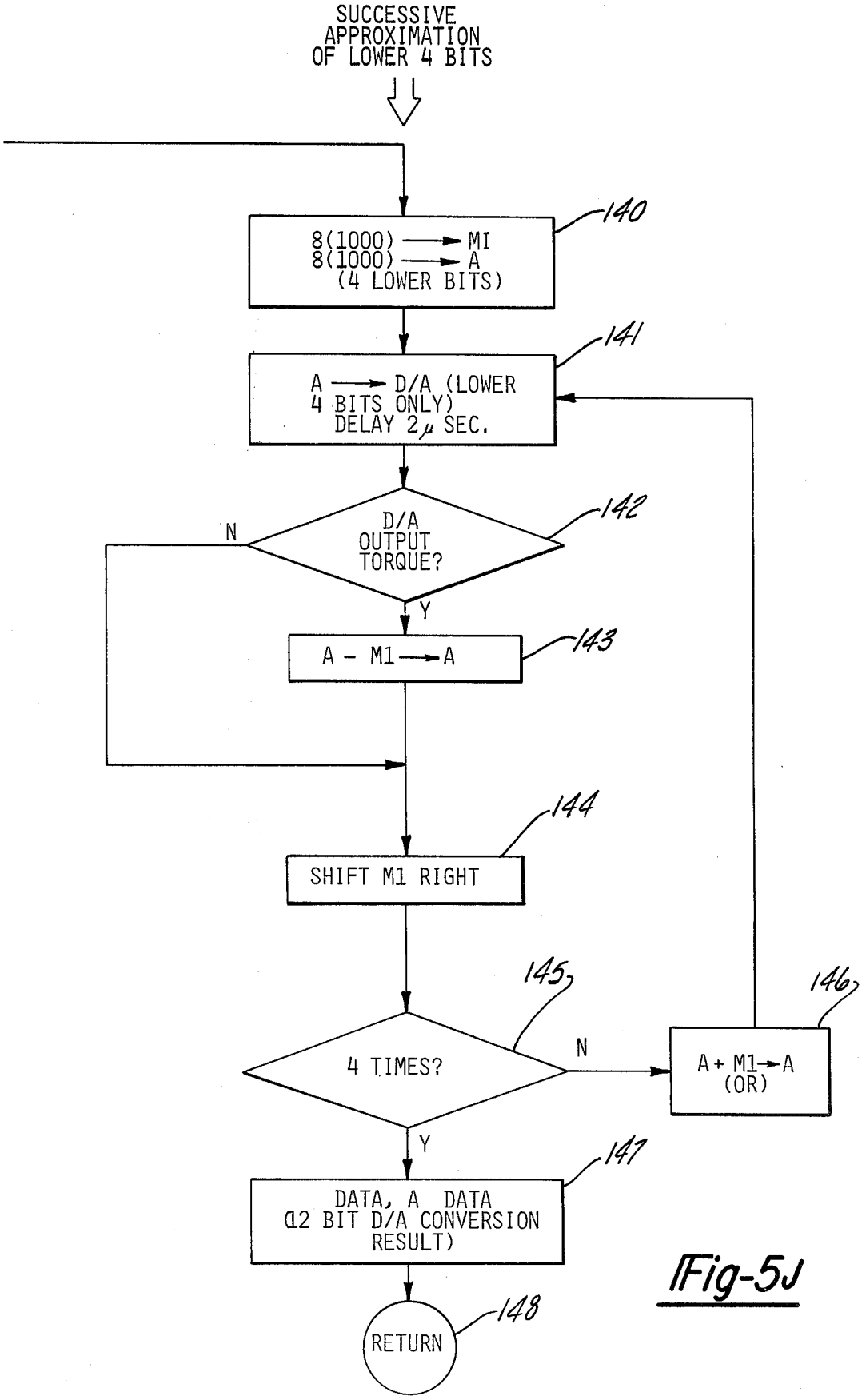

If there has been no discernible valley or if the valley occurs before the coarse breakaway point, then a program branches to the routine shown in FIG. 5F. Steps 280–288 may be optionally used to define a new coarse breakaway torque value by calculating the arc tangent of every tenth point from peak to the original coarse breakaway location. The location of the same associated with the minimum arc tangent is saved in a storage location labeled BRKLOC. Regardless of whether the coarse breakaway point $B_c$ is recalculated via steps 280–288 or the original point is utilized, the next major step is to pinpoint the exact or final breakaway torque. With additional reference to FIG. 2C, the final breakaway value calculation will be described.

Figure 2C:
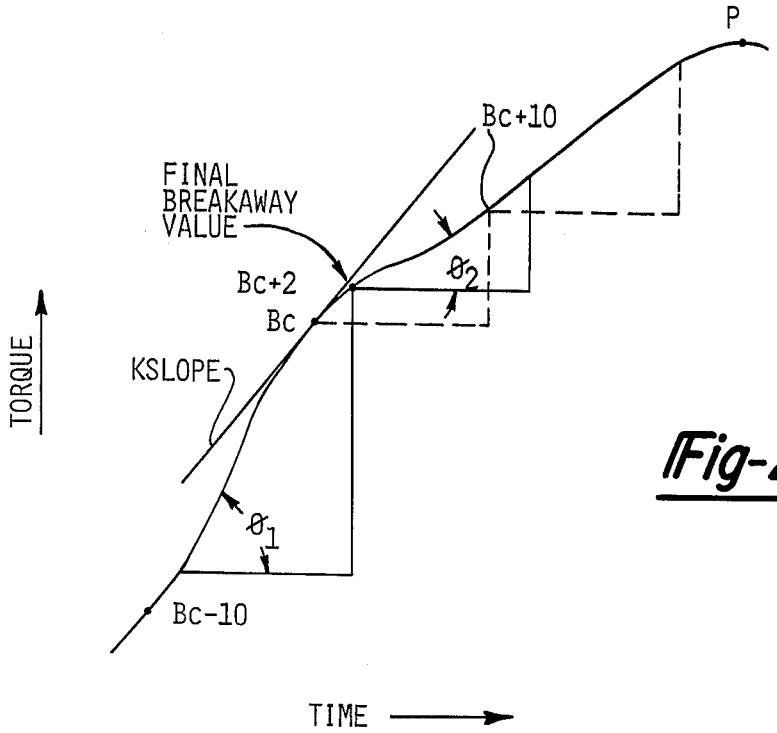

FIG. 2C is an enlarged portion of a typical breakaway curve adjacent to the chosen coarse breakaway point $B_c$. Microprocessor 44 operates to calculate the arc tangent for every point on the torque curve within a given range of the coarse breakaway point. In this embodiment, arc tangent calculations are made for each digital sample within the range of ten from the sample associated with the coarse breakaway sample. In FIG. 2C, the outer range of this arc tangent process is defined by the points $B_c-10$ and $B_c+10$. The calculation of the arc tangent for each of these points may be accomplished in a variety of manners. In this embodiment, microprocessor 44 operates to calculate the angle between segments on opposite sides of the point. Ten sample wide segments are chosen in this particular example and are illustrated in dotted lines for point $B_c+10$ in FIG. 2C. For point $B_c+2$, these segments are shown in solid lines. Briefly, the arc tangent routine calculates the angles $\phi 1$ and $\phi 2$ for each of the segments and then takes the difference between these angles. The difference is subtracted from 180 degrees to determine the angle defined by segments on either side of the selected point. This process is analogous to taking the second derivative of each of the points.

In FIG. 5F steps 292–298 are utilized to determine the minimum arc tangent calculated for each of the points on the curve. The torque of the digital sample associated with the point having the minimum arc tangent is chosen as the final breakaway value. In FIG. 2C this torque corresponds to the point $B_c+2$.

As noted before, under some circumstances the valley torque or negative peak will be displayed whereas in other circumstances the final breakaway value will be displayed in step 302. If the valley torque is displayed buzzer 58 is activated to beep twice whereas it will operate to beep once if the breakaway value is displayed (steps 304-308). Then, the program returns back to loop 1 and is ready for measurement of another fastener during another subsequent test.

The method of determining the so called "retorque" value as just described is designed to optimize the accuracy of the measurement while at the same time minimizing manufacturing costs. It should be realized that the torque curves shown in the drawings are idealized and that, in actual use, individual digital sample values may vary quite dramatically from the normal progression of the average spectrum of values. Such abberations are to be expected when it is realized that the torque wrench is designed to be used in an industrial environment by a human operator. Thus, it is expected that a certain amount of electrical noise and operator induced error can be expected. The present invention takes great pains to eliminate as many of these noninformative data samples from effecting the accuracy of the ultimate measurement. Of course, the operator error can be minimized by using automated machines to apply the retorquing forces to the fasteners under test and such a modification falls within the spirit of the invention. However, in many quality control applications it is desirable to provide a manually operated device as shown in the preferred embodiment.

Therefore, while this invention has been described in connection with particular examples thereof, no limitation is intended thereby except as defined in the appended claims. For example, instead of a torque verses time curve, torque-angle calculations for the digital samples may be employed if an angle decoder device is used to detect the rotation of the wrench. Various other modifications will become apparent to one skilled in the art upon a study of the drawings and specification as well as the claims.

We claim:

1. In a method of detecting breakaway or valley torque levels associated with the amount of previously applied torque to a fastener, wherein torque is subsequently applied to the fastener in the tightening direction until further motion of the fastener is obtained, and wherein an analog signal is generated as a function of the subsequently applied torque, the improvement comprising:

(a) sampling the analog signal and converting it into a plurality of digital sample values;
(b) comparing successive sample values;
(c) sequentially storing progressively increasing digital sample values in a sequential memory whereby a peak value is stored therein;
(d) storing a negative sample value in a second memory portion for successive sample values which are less than the largest preceding digital sample value;
(e) terminating steps a–d when the digital sample values are less than a given threshold value;
(f) defining a window of stored samples occurring before the peak value;
(g) scanning the samples in the sequential memory portion beginning with the peak value and progressing backwards to decreasing sample values to determine if a valley region has occurred within said window; and
(h) if so, displaying said negative peak value as an indication of the amount of previously applied torque to the fastener.

2. In a method of detecting breakaway or valley torque levels associated with the amount of previously applied torque to a fastener, wherein torque is subsequently applied to the fastener in the tightening direction until further motion of the fastener is obtained, and wherein an analog signal is generated as a function of the subsequently applied torque, the improvement comprising:

(a) sampling the analog signal and converting it into a plurality of digital sample values;
(b) comparing successive digital sample values;
(c) storing progressively increasing digital sample values in a sequential memory whereby a peak value is stored therein;
(d) placing a valley detection flag in said sequential memory to indicate the occurrence of a valley when the comparison indicates that successive sample values are less than the largest preceding sample value;
(e) storing a negative peak value corresponding to the smallest digital sample value occurring for each valley;
(f) terminating steps a–e when the sample values have values less than a given threshold value;
(g) defining a window of stored sample values occurring before the peak as a function of the peak value;
(h) scanning the sequential memory in a backward direction beginning with the peak and progressing to decreasing values to check for the occurrence of a valley detection flag;
(i) selecting the negative peak value associated with the first encountered valley if the negative valley torque is within said window;
(j) selecting a digital sample value in said sequential memory as a coarse breakaway value by successively comparing slopes associated with said digital samples with a preselected slope;
(k) determining whether said valley is located closer to the peak than the selected coarse breakaway point; and
(l) if so, displaying said negative peak value of the valley as an indication of the amount of previously applied torque to the fastener.

3. The method of claim 2 where, in a second mode of operation, the digital sample value occurring prior to the valley is selected as the indication of the amount of previously applied torque to the fastener to be displayed.

4. The method of claim 2 where if no valley occurred within said window or if the coarse breakaway point is closer to the peak than the valley, then the method further includes the steps of:

calculating the arc tangent for digital sample values adjacent to the digital sample value associated with the coarse breakaway point; and displaying the digital sample value associated with the minimum arc tangent as the amount of previously applied torque to the fastener.

5. The method of claim 2 wherein said window is defined as a range of digital sample values between substantially the peak and 80% of the peak value.

6. In a method of detecting breakaway torque levels associated with the amount of previously applied torque to a fastener, wherein torque is subsequently applied to the fastener in the tightening direction until further motion of the fastener is obtained, and wherein an analog signal is generated as a function of the subsequently applied torque, the improvement comprising:

(a) sampling the analog signal and converting it into a plurality of digital sample values;
(b) storing said sample values in sequential memory locations;
(c) comparing the slopes of segments of said digital samples with a preselected slope;
(d) selecting a given sample value as a coarse breakaway point as a function of said slope comparisons;
(e) calculating the arc tangent for digital sample values adjacent said coarse breakaway digital sample;
(f) selecting the digital sample value having the minimum arc tangent; and
(g) displaying said selected digital sample value as an indication of the amount of previously applied torque to the fastener.

* * * * *